United States Patent [19]

Tomasi

[11] Patent Number: 4,892,239

[45] Date of Patent: Jan. 9, 1990

[54] DEVICE FOR MAKING IT EASIER TO PUT ON ARTICLES OF CLOTHING

[76] Inventor: Walter Tomasi, Weilheimer Str. 21, D-7890 Waldshut/Tiengen, Fed. Rep. of Germany

[21] Appl. No.: 305,987

[22] PCT Filed: May 28, 1988

[86] PCT No.: PCT/DE88/00317

§ 371 Date: Jan. 23, 1989

§ 102(e) Date: Jan. 23, 1989

[87] PCT Pub. No.: WO88/09637

PCT Pub. Date: Dec. 15, 1988

[30] Foreign Application Priority Data

Jun. 1, 1987 [DE] Fed. Rep. of Germany ..... 3718330

[51] Int. Cl.[4] ..... A47G 25/90

[52] U.S. Cl. ..... 223/111

[58] Field of Search ..... 223/111

[56] References Cited

U.S. PATENT DOCUMENTS 549,253 11/1895 Parr ..... 223/111
587,616 8/1897 Stuart ..... 223/111
775,508 11/1904 Beam ..... 223/111

FOREIGN PATENT DOCUMENTS 101931 8/1897 Fed. Rep. of Germany ..... 223/111
205986 1/1908 Fed. Rep. of Germany ..... 223/111
3203266 1/1983 Fed. Rep. of Germany .
2136191 12/1972 France .

*Primary Examiner*—Werner H. Schroeder
*Assistant Examiner*—David K. Suto
*Attorney, Agent, or Firm*—Bachman & LaPointe

[57] ABSTRACT

The present invention relates to a device for making it easier to put on articles of clothing, such as coats, jackets or the like, with a holding device mounted so as to be of adjustable height on a vertical guide (1). The holding device has two half-hangers (3, 4) articulated by means of hinges (5, 6) with oblique axial directions (1, II). These half-hangers (3, 4) are tiltable forwards and obliquely downwards out of the horizontally aligned first end position into a second end position. Furthermore, a drive (7–10) actuable by the person putting on the particular article of clothing while he is putting it on is provided for varying the height *h*) of the holding device on the vertical guide (1). The device according to the invention affords in full and in the same way the assistance otherwise normally given by a helper in order to put on an article of clothing.

15 Claims, 1 Drawing Sheet

DEVICE FOR MAKING IT EASIER TO PUT ON ARTICLES OF CLOTHING

FIELD OF THE INVENTION

The present invention relates to a device for making it easier to put on articles of clothing, such as coats, jackets or the like, with a holding device for the articles of clothing which is mounted so as to be of adjustable height on a vertical guide by means of a connecting element.

PRIOR ART

Devices of the type mentioned are already known, and for example reference can be made to DE-OS No. 2,117,080. However, a common feature of the known devices is that they are not capable of giving the person putting on the article of clothing any assistance even remotely comparable to that usually given by a helper when coats, jackets or the like are put on.

SUMMARY OF THE INVENTION

The object of the present invention is to provide a device of the type mentioned in the introduction, which is capable of replacing in full the usual assistance given by the helper.

According to the present invention, the object mentioned and further objects are achieved by the provision of a device as defined in claim 1.

The device according to the invention affords in full the assistance otherwise normally given by helpers when coats, jackets or the like are put on. The device according to the invention helps the person putting on the coat or jacket into it in the usual way. There is no need for the person to change his habits. The device according to the invention is simple and reliable to operate. It is therefore especially suitable for older people and the disabled.

Advantageous embodiments of the invention are defined in the dependent patent claims.

BRIEF DESCRIPTION OF THE DRAWING

Further advantages and features of this invention and the use of the device according to the invention emerge from the following detailed description of an exemplary embodiment, particularly with reference to the accompanying drawing.

In this.

In the Figures, identical parts bear identical reference symbols.

DETAILED DESCRIPTION

Figure 1:
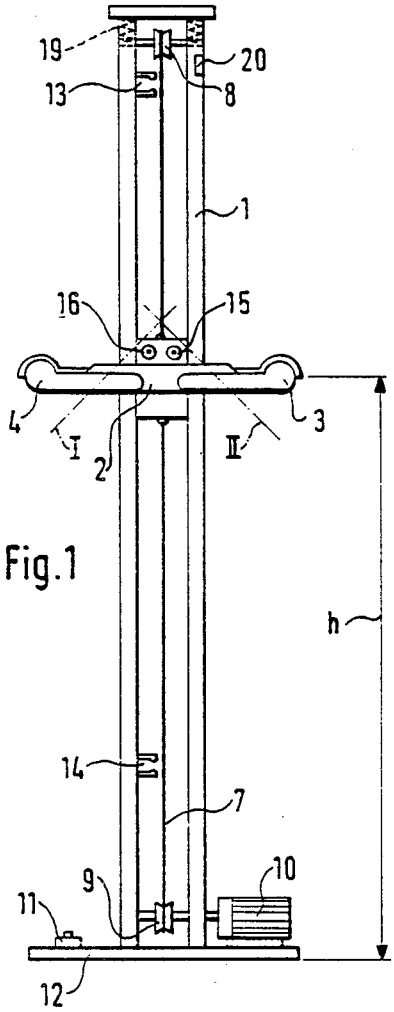
FIG. 1 shows an elevation view of a device according to the invention.

Reference is now made to the drawings. In these, 1 denotes a vertical guide which here is formed, for example by two parallel rods of U-shaped profile. Guided vertically by the vertical guide 1 is a connecting element 2, to which the holding device for the articles of clothing to be put on, but themselves not shown, is fastened, this holding device comprising essentially the half-hangers 3 and 4. The half-hangers 3 and 4 are articulated on the connecting element 2 by means of hinges 5 and 6, specifically at the same height h and at a distance d of approximately 24 cm from one another. The said distance could also be shorter, for example 16 cm, or longer, for example 30 cm. It is governed by the shoulder width of the articles of clothing. In principle, it is directly possible to make this distance adjustable by means of a suitable design of the connecting element 2. For this purpose, for example, the connecting element 2 could be made in two parts, so that the two half-hangers 3 and 4 can be drawn apart from one another by means of suitable adjusting elements, such as a gear wheel meshing with two racks, one rack being connected to each part of the connecting element 2. However, this is not provided in the exemplary embodiment chosen.

The two half-hangers 3 and 4 are preferably each of a length of 30 cm. They are articulated on the connecting element 2 by means of the hinges 5 and 6, in such a way that, in one end position, designated hereafter as the first, they are aligned horizontally approximately in a straight line and, in this position, project outwards over approximately two thirds of their length beyond the hinges 5 and 6 and correspondingly inwards over approximately one third of their length beyond the hinges 5 and 6, that is to say into the region between the hinges 5 and 6.

The two half-hangers 3 and 4, preferably in the region of their outer ends in the first end position, are either bent upwards or, as shown in the Figures, have a bead there on their upper side. This bead can preferably, but not necessarily also be covered with a material, such as for example rubber, which has a high coefficient of friction for articles of clothing. Otherwise, the surface of the half-hangers 3 and 4 is smooth.

The actual design of the vetical guide 1 and of the connecting element 2 is not of critical importance for the present invention. It is merely important that the vertical guide 1 should allow an adjustment of the height h of the conecting element 2, together with the holding device fashioned to it, of approximately between 90 cm and 210 cm above ground, and that the connecting element 2 should allow the articulation of the half-hangers 3 and 4 at the said distance of 10 to 30 cm from the vertical guide 1. In addition, the connecting element 2 must make it possible to tilt the half-hangers 3 and 4, as explained below. The connecting element 2 preferably has a fork-like shape.

Figure 2:
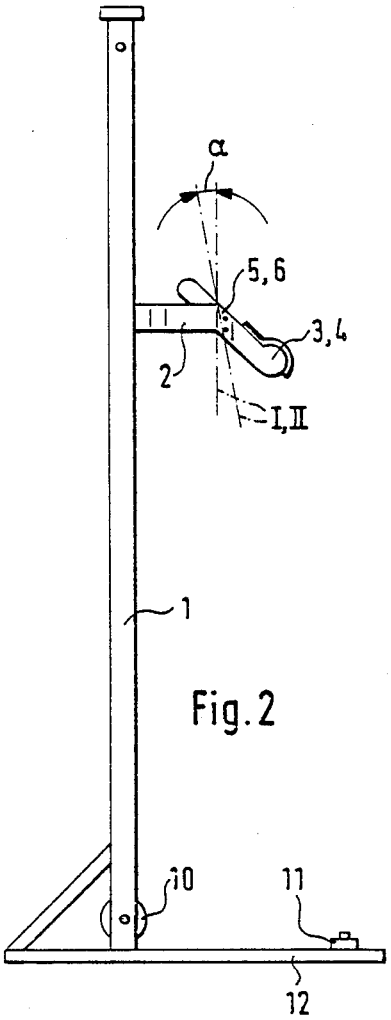
FIG. 2 shows a side view of the device according to FIG. 1.

The axial directions I and II of the two hinges 5 and 6 are inclined relative to one another, specifically by approximately 45° relative to the vertical guide 1. The said axial directions I and II accordingly intersect approximately at right angles above the holding device. The longitudinal direction of each of the two half-hangers 3 and 4 is itself inclined respectively at approximately 45° relative to the two axial directions I and II. The two half-hangers 3 and 4, from their abovementioned first end positions determined by corresponding first stops, can be tilted only forwards, that is to say away from the vertical guide 1. As a result of the alignment of the axial directions I and II of the hinges 5 and 6, these at the same time move obliquely downwards. At a respective angle of rotation of approximately 90°, a second end position is defined by second stops, as can be seen in FIG. 2.

In the first end position shown in FIG. 1, the two half-hangers 3 and 4 will preferably additionally be in stable equilibrium under the effect of gravity. This is achieved by slightly tilting the plane defined by the axial directions I and II of the two hinges 5 and 6 rearwards towards the vertical guide 1, as can likewise be seen in FIG. 2. The tilting angle $\alpha$ should not amount to more than approximately 10°.

Figure 3:
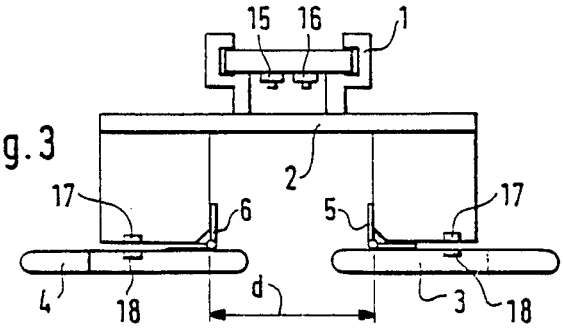
FIG. 3 shows a plan view of the device according to FIGS. 1 and 2.

However, as indicated in FIG. 3, it is also possible to provide on the connecting element 2 activatable magnets 17 which interact with corresponding counter-surfaces 18 in the half-hangers 3 and 4.

For this, the magnets 17 can be connected to a current source via appropriate leads and sliding contacts, not shown in detail, between the connecting element 2 and the vertical guide 1. At the same time, this contact is preferably designed in such a way that it is broken after a predetermined stroke of the connecting element 2, so that the half-hangers 3 and 4 have freedom of movement for giving up the article of clothing.

In order to adjust the height h of the holding device on the vertical guide 1, there is a motor drive which is formed by an electric motor 10 and a rope 7 guided via two rope pulleys 8 and 9. The lower rope pulley 9 is driven by the electric motor 10. Instead of using a rope and rope pulleys, there could also be a chain in conjunction with the gear wheels or there could be further elements of equivalent effect. The electric motor 10 can be started by means of a foot switch 11 which is preferably a button. The foot switch 11 is arranged, for example, on a baseplate 12, in such a way that the person putting on the article of clothing can easily reach and actuate it with the foot while he is putting it on.

However, the foot switch 11 is only one exemplary embodiment of the invention. For example, for the disabled, there is also the possibility of remote control here. For disabled persons whose leg functions are impaired, there can also be the possibility of switching on the motor by introducing their hands into the sleeves, because the switch is touched through the sleeve, for example on the vertical guide 1. No limit will be placed on the invention here.

Furthermore, there are also two limit swithes 13 and 14 which limit the vertical adjustablity of the holding device between a lower and an upper extreme position for example, respectively 70 cm and 170 cm above the floor or the baseplate 12. The two limit switches 13 and 14 are preferably so designed and connected to the foot switch 11 and electric motor 10 that, when either of them is actuated because the connecting element 2 comes up against it, the direction of rotation of the electric motor 10 is respectively reversed. Furthermore, on the connecting element 2 there are also two manually actuable switches 15 and 16 which are connected to the said circuit and can also easily be reached there and which are designed as buttons. When these switches are actuated, the holding device can consequently move respectively upwards and downwards on the vertical guide 1. By means of these switches 15 and 16, the sleeve-hole height is adjusted according to a predetermined body size. For this purpose, a scale can be located, for example, on the vertical guide 1.

The lower limit switch 14 can be made manually adjustable, so that even a disabled person can easily adjust the height of the half-hangers 3 and 4 according to his sleeve-hole height depending on body size, without the assistance of another person.

Instead of an electromotive drive, alternatively there could also be a hydraulic or other suitable mechanical drive for adjusting the height of the holding device on the vertical guide 1. However, it must be possible for the person putting on the article of clothing to actuate all the drives during the actual time when he is putting it on.

As regards the use of the device according to the invention, this emerges as follows, the assumption being made that the electromotive drive illustrated in the drawings, together with the switches 11 and 13 to 16 likewise illustrated, is provided:

As a result of the actuation of the foot switch 11 or of one of the two switches 15 or 16, the holding device is first moved into a position approximately in the region of the lower extreme position. The two half-hangers 3 and 4 are tilted into the first end position. The article of clothing to be put on is then hung by its shoulder part over the half-hangers 3 and 4, in the opened state and with its inside or lining side facing forwards that is to say away from the vertical guide 1, specifically in such a way that the half-hangers 3 and 4 are in contact with the outside of the shoulder parts and not with the inside, as is otherwise customary with clothes-hangers. As a result of the special geometry chosen for the holding device of the device according to the invention, after the article of clothing has been hung on the holding device in the way described, it is offered to the person wanting to put it on in the same way as if it were held by an assistant in a suitable way for being put on.

Accordingly, the person wanting to put on the article of clothing need only stand with his back aginst the device according to the invention, hold his arms outstretched somewhat to the rear and insert them into the arm-holes of the wide-open article of clothing. If the holding device is set at a suitable height, the arm-holes are located exactly at the height appropriate for this purpose. If necessary, even after the article of clothing has been hung on the half-hangers 3 and 4, this height can still be corrected by actuating the switches 15 and 16.

After the arms have been slipped into the armholes, the actual putting-on operation is triggered by actuating the foot switch 11. As a result of the actuation of the foot switch 11, the article of clothing to be put on is drawn upwards by the holding device, with the result that the arms of the person putting on the article of clothing slide into the sleeves of the latter.

When the holding device, in its upward movement along the vertical guide 1, has reached a specific height at which the arms of the person putting on the article of clothing are already essentially completely inside the sleeves, the article of clothing exerts a pull on each of the two half-hangers 3 and 4 forwards, that is to say towards the person putting on the article of clothing. This pull causes the half-hangers 3 and 4 to tilt forwards out of their first end position into the second end position, thereby automatically releasing the article of clothing and laying its shoulder parts gently and efficiently over the shoulders of the person putting it on. Before the article of clothing is discarded automatically in this way, it merely exerts a downward pull on the two half-hangers 3 and 4, thereby retaining these in the first end position. This pull also increases when the arms of the person putting on the article of clothing slide into the sleeves during the operation of putting it on.

In a preferred embodiment of the invention, there is an overload protection which causes a reversal of the motor 10 according to the article of clothing and according to the pull. On the one hand, this overload protection is possible by means of an appropriate device on the motor 10 itself, the latter changing over when a predetermined torque is exceeded.

In another embodiment, however, for example the upper pulley 8 is suspended on springs 19 represented by broken lines in FIG. 1. When an increased pull is exerted on the pulley 8, for example when an article of clothing remains hanging on the connecting element 2 or the half-hangers 3 and 4, the pulley 8 is drawn downwards and there reaches an overload switch 20, by means of which the rotation of the motor is changed over. This overload switch 20 is located, for example, on a spur rack or threaded spindle and is adjustable according to the weight of the article of clothing. This can take place continuously or in predetermined steps (for example, overshirt, jacket, summer coat, winter coat).

The selected shape of the half-hangers 3 and 4 and the rubberising of their upper sides, which is additionally provided where appropriate, prevent the article of clothing from sliding down from the half-hangers 3 and 4 prematurely. With a view to special articles of clothing, there can be additional retention, for example in the form of clamps which are under spring pressure, but there is normally no need for such additional retention.

Those parts of the half-hangers 3 and 4 projecting inwards beyond the hinges 5 and 6 in the first end position perform the following function:

They serve to enable the person putting on the article of clothing, as desired, to trigger the tilting of the two half-hangers 3 and 4 out of the first end position into the second end position at an earlier moment than would occur automatically.

During the upward movement of the holding device and the sliding of the arms into the sleeves of the article of clothing, the person putting it on need only lean backwards somewhat and with his back exert slight pressure on the two said inwardly projecting parts of the half-hangers 3 and 4, in order to trigger the tilting of these or make it easier. By utilizing this possibility of control, a perfect and gentle laying of the article of clothing over the shoulders can be achieved.

I claim:

1. A device for making it easier to put on articles of clothing, such as coats, jackets or the like, with a holding device for the articles of clothing which is mounted so as to be of adjustable height on a vertical guide (1) by means of a connecting element (2), wherein the holding device has two half-hangers (3, 4) articulated on the connecting element (2) by means of hinges (5, 6) the axial directions (I, II) of the hinges (5, 6) intersecting at an angle above the holding device, and the half-hangers (3, 4) being tiltable about the said axial direction (I, II) approximately horizontal, oppositely aligned first end position forwards away from the vertical guide (1) into a second end position, and wherein a drive (7–10) actuable by the person putting on the particular article of clothing is provided for varying the height (h) of the holding device on the vertical guide (1).

2. A device as claimed in claim 1, wherein the angle is approximately 90°.

3. A device as claimed in claim 1, wherein the plane defined by the axial directions (I, II) of the two hinges (5, 6) is tilted at an angle (*a*) of approximately 10° to 20° rearwards towards the vertical guide (1), so that, in the first end position, the half-hangers (3, 4) are in stable equilibrium under the effect of gravity.

4. A device as claimed in claim 1, wherein magnets (17) with corresponding counter-surfaces (18) are provided between the connecting element (2) and the half-hangers (3, 4).

5. A device as claimed in claim 4, wherein the magnets (17) are activatable over a predetermined stroke length of a connecting element (2).

6. A device as claimed in claim 1, wherein the half-hangers (3, 4) have a length of approximately 30 cm, and in the first end position approximately two thirds of this length projects outwards beyond the hinges (5, 6) and approximately one third of this length projects beyond the hinges (5, 6) into the region between these.

7. A device as claimed in claim 1, wherein the half-hangers (3, 4) in the region of their outer ends, has a thickened region.

8. A device as claimed in claim 1, wherein the half-hangers (3, 4) are equipped, at least on their upper side and in the region of their outer ends, with a rubberising which has a high coefficient of friction for articles of clothing and which otherwise has a smooth surface.

9. A device as claimed in claim 1, wherein the drive (7–10) for varying the height (h) of the holding device is an electromotive drive which is actuable by means of a switch (11) by the person putting on the article of clothing.

10. A device as claimed in claim 1, wherein an upper and a lower limit switch (13 and 14) limit the stroke distance of the connecting element (2).

11. A device as claimed in claim 10, wherein the lower limit switch (14) is vertically adjustable.

12. A device as claimed in claim 1, wherein an overload protection is provided.

13. A device as claimed in claim 12, wherein the overload protection comprises an overload switch (20) which interacts with a suspension (8) of the connecting element (2).

14. A device as claimed in claim 13, wherein the overload switch (20) is vertically adjustable.

15. A device as claimed in to claim 1, wherein the distance (d) between the two half-hangers (3, 4) is variable.

* * * * *